US007866799B2

(12) United States Patent
Nabeshima et al.

(10) Patent No.: US 7,866,799 B2
(45) Date of Patent: Jan. 11, 2011

(54) LIQUID DISCHARGE HEAD

(75) Inventors: Naozumi Nabeshima, Kawasaki (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 1121 days.

(21) Appl. No.: 11/468,171

(22) Filed: Aug. 29, 2006

(65) Prior Publication Data

US 2007/0046733 A1 Mar. 1, 2007

(30) Foreign Application Priority Data

Sep. 1, 2005 (JP) ..... 2005-253544

(51) Int. Cl.
*B41J 2/05* (2006.01)

(52) U.S. Cl. ..... 347/65; 347/47; 347/56; 347/94; 347/27

(58) Field of Classification Search ..... 347/65, 347/47, 44, 6, 7, 56, 63, 64, 93, 94, 27
See application file for complete search history.

(56) References Cited

U.S. PATENT DOCUMENTS 4,558,333 A * 12/1985 Sugitani et al. ..... 347/65
4,794,410 A * 12/1988 Taub et al. ..... 347/65
5,206,659 A * 4/1993 Sakurai et al. ..... 347/62
5,398,053 A 3/1995 Hirosawa et al.
5,402,160 A 3/1995 Kadowaki et al.
5,451,989 A 9/1995 Kadowaki et al.
5,512,924 A 4/1996 Takada et al.
5,828,387 A 10/1998 Wataya et al.
5,872,582 A * 2/1999 Pan ..... 347/65
5,924,197 A 7/1999 Murakami et al.
6,003,977 A * 12/1999 Weber et al. ..... 347/63
6,283,584 B1 * 9/2001 Powers et al. ..... 347/65
6,305,080 B1 10/2001 Komuro et al.
6,561,631 B2 5/2003 Shin et al.
6,588,887 B2 * 7/2003 Ogawa ..... 347/61
6,652,079 B2 11/2003 Tsuchii et al.
6,663,229 B2 * 12/2003 Komuro et al. ..... 347/65
6,824,248 B2 11/2004 Tsuchii
6,830,317 B2 12/2004 Tsuchii et al.
6,921,153 B2 * 7/2005 Silverbrook ..... 347/54
6,976,748 B2 12/2005 Yabe et al.
6,984,025 B2 1/2006 Kaneko et al.
6,988,786 B2 1/2006 Kaneko et al.
7,077,503 B2 7/2006 Kaneko et al.
7,172,264 B2 2/2007 Kaneko et al.

(Continued)

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

A liquid discharge head includes a substrate which has a heating resistive element for generating a bubble in a liquid, and a first wall member which faces the heating resistive element. A discharge port which discharges the liquid is provided in the first wall member, and an ink channel communicated with the discharge port is formed between the substrate and the first wall member. In the liquid discharge head, the substrate includes a second wall member around the heating resistive element, the second wall member being protruded in a direction toward the discharge port, the first wall member includes a protrusion portion in a surface facing the substrate, the protrusion portion being protruded toward the heating resistive element, and an end portion of the protrusion portion exists in a region in which the second wall member surrounds the heating resistive element.

6 Claims, 4 Drawing Sheets

U.S. PATENT DOCUMENTS

2002/0039127 A1* 4/2002 Shin et al. ..... 347/65
2005/0285907 A1* 12/2005 Park et al. ..... 347/65
2006/0044350 A1 3/2006 Tsuchii
2006/0119663 A1 6/2006 Tsuchii
2007/0035580 A1 2/2007 Ide et al.

* cited by examiner

LIQUID DISCHARGE HEAD

BACKGROUND OF THE INVENTION

1. Field of the Invention

The present invention relates to a liquid discharge head which discharges a liquid, specifically to an ink jet recording type of ink jet recording head which discharges ink to a recording medium to perform recording. Particularly, the invention relates to an ink jet recording head in which a shape of a discharged ink droplet is improved to enhance print performance and image quality by improving a structure of a liquid channel.

2. Description of the Related Art

In a thermal drive type used in the ink jet recording type, the liquid near a heating resistive element is instantaneously boiled by applying voltage to the heating resistive element, and the droplet is discharged by bubbling pressure generated due to a phase change in liquid. The liquid discharged from a discharge port forms a droplet by surface tension, and the liquid forms an image on a predetermined recording medium.

After the liquid is discharged, the droplet having an amount according to a volume of the discharged droplet is refilled from an ink tank through an ink supply port and an ink channel.

The liquid is not a spherical droplet but a columnar shape including a large main droplet portion and a long and thin tail portion immediately after the liquid is discharged from the discharge port of the printhead described above. The liquid column breaks apart into plural droplets by the surface tension of the liquid during a procedure in which the liquid column flies toward the recording medium from the discharge port. In the most general mode, the liquid column is divided into the main droplet portion and the tail portion, and then the tail portion is further divided into satellite droplets by the surface tension.

When the satellite droplets adhere to the recording medium, there is a problem that the satellite droplets become noises to prevent fine image formation. Recently the influence of the problem is increasing as the discharged main droplet portion is decreased. Furthermore, because the satellite droplet is extremely small, after the satellite droplet floats in air by the influence of air resistance or an air flow, the satellite droplet adheres to the ink tank or a printer main body, which results in a problem that the satellite droplet soils a hand of a user. Additionally, there are also possibly generated problems such that a sheet feeder malfunction is generated by the adhesion of the satellite droplets to an encoder, and such that printer main body breakdown is generated by the adhesion of the satellite droplets to an electric substrate.

The satellite is reduced by decreasing a droplet tail during the ink discharge.

U.S. Pat. No. 6,561,631 discloses a method of decreasing the droplet tail. According to the method disclosed in U.S. Pat. No. 6,561,631, in the ink discharge procedure from the bubble generation to the ink droplet separation, the ink going toward the discharge port by the bubble growth and the ink in the ink channel are blocked by the bubble, and only the ink isolated near the discharge port is discharged. Therefore, the generation of the droplet tail is suppressed.

However, in the technique disclosed in U.S. Pat. No. 6,561,631, because flow resistance is enhanced in a part of the ink channel in order to obtain the above-described effect, sometimes it takes a long time to refill the ink after the ink discharge, namely sometimes so-called refill characteristics become worsened. Therefore, it is difficult that the satellite generation is suppressed while a discharge frequency not lower than 15 kHz, which corresponds to recently demanded high-speed print, is maintained.

SUMMARY OF THE INVENTION

In view of the foregoing, an object of the invention is to provide a liquid discharge head which suppresses a satellite generation without losing refill characteristics as much as possible.

A liquid discharge head according to a first aspect of the invention having a substrate which has a heating resistive element for generating a bubble in a liquid; and a first wall member which faces the heating resistive element, a discharge port which discharges the liquid being provided in the first wall member, the first wall member forming an ink channel communicated with the discharge port between the substrate and the first wall member, wherein the substrate includes a second wall member around the heating resistive element, the second wall member being protruded in a direction toward the discharge port, the first wall member includes a protrusion portion in a surface facing the substrate, the protrusion portion being protruded toward the heating resistive element from the surface, an end portion of the protrusion portion is closer to the heating resistive element than an end portion of the second wall member, and a projection region of the protrusion portion to the substrate in the direction toward the heating resistive element is included in a region of the heating resistive element.

A liquid discharge head according to a second aspect of the invention having a substrate which has a heating resistive element for generating a bubble in a liquid; and a first wall member which faces the heating resistive element, a discharge port which discharges the liquid being provided in the first wall member, the first wall member forming an ink channel communicated with the discharge port between the substrate and the first wall member, wherein the substrate includes a second wall member around the heating resistive element, the second wall member being protruded in a direction toward the discharge port, the first wall member includes a protrusion portion in a surface facing the substrate, the protrusion portion being protruded toward the heating resistive element, and an end portion of the protrusion portion exists in a region which is formed by the surrounding the heating resistive element with the second wall member.

In the ink jet recording head of the invention, the second wall member which is protruded toward the discharge port direction is provided around the heating resistive element, and the opening on the substrate side of the discharge port is included in the end portion on the substrate side of the protrusion portion. The protrusion portion is protruded toward the substrate from the first wall member in which the discharge port is provided. Because the end portion of the protrusion portion is closer to the heating resistive element than the end portion of the second wall member, the bubble whose growth is promoted in the discharge port direction by the second wall member closes the opening on the heating resistive element side of the protrusion portion, and the bubble divides the ink flow into the flow of the discharged ink and the flow of the ink in the ink channel during the discharge. Only the ink which exists between the opening on the substrate side of the protrusion portion and the discharge port in the divided ink is used for the discharge, so that droplet tail is decreased to suppress the satellite generation to a low level. In the ink jet recording head of the invention, the bubble growth direction during the discharge is limited to the discharge direction by the second wall member, which prevents the pressure toward the direction opposite to the direction in which the ink is moved in the ink channel during the refill as much as possible. Accordingly, the ink jet recording head of the invention can balance the suppression of the satellite generation with the refill characteristics.

Further features of the present invention will become apparent from the following description of exemplary embodiments (with reference to the attached drawings).

DESCRIPTION OF THE EMBODIMENTS

Figure 1:
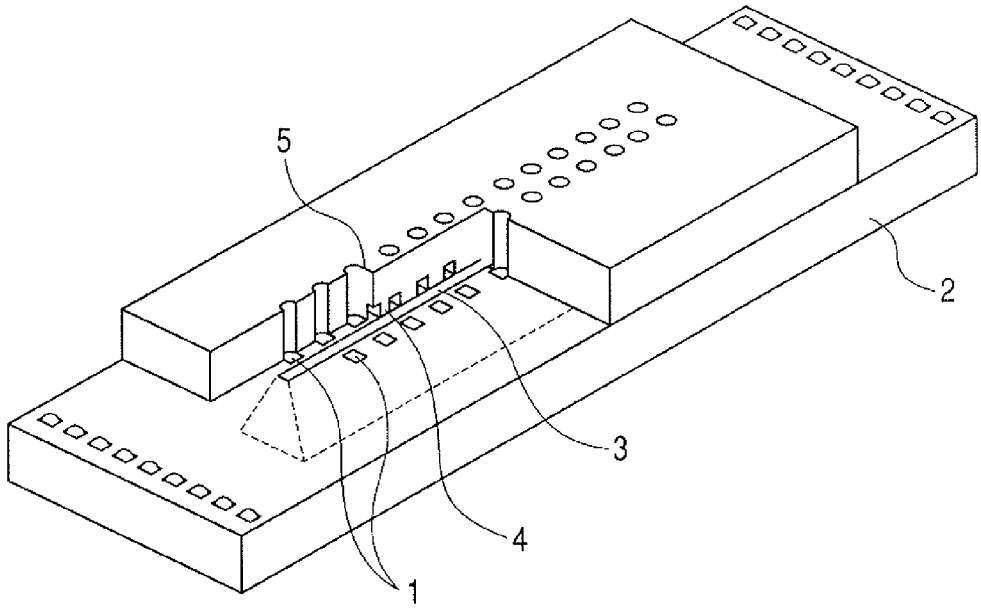
FIG. 1 is a perspective view showing a configuration example of an ink jet recording head according to the invention.

Embodiments of the invention will be described below with reference to the accompanying drawings. In the following descriptions, the component having the same function is designated by the same numeral in the drawings, and sometimes the description will not be described.

In the description, the invention is applied to an ink jet recording type by way of example. However, the application of the invention is not limited to the ink jet recording type, but the invention can also be applied to biochip production, electronic circuit printing, and the like.

An ink jet recording head (recording head) to which the invention is applicable will first be described.

FIG. 1 is a schematic view showing an ink jet recording head according to an embodiment of the invention.

The recording head of the embodiment has an Si substrate 2 in which heating resistive elements 1 are arranged in two lines at predetermined intervals. The heating resistive element 1 is of an ink discharge pressure generating element (ink discharge energy generating element). In the substrate 2, an ink supply port 3 is formed between the two-line heating resistive elements 1. The ink supply port 3 is formed by anisotropic etching of Si. Discharge ports 5 and ink channels 6 are formed on the substrate 2. The discharge port 5 is opened above each heating resistive element 1 by an ink channel wall forming member 4, and each discharge port 5 is individually communicated with the ink supply port 3 through the ink channel 6.

The recording head is arranged such that a surface in which the ink supply port 3 is formed faces a recording surface of the recording medium. In the recording head, the ink droplet is discharged from the discharge port 5 by applying the pressure generated by the heating resistive element 1 to the ink filled in the ink channel through the ink supply port 3, and the recording is performed by causing the ink droplet to adhere to the recording medium.

The recording head can be incorporated into a printer, a copying machine, a facsimile machine, an apparatus such as a wordprocessor having a printer unit, and industrial recording apparatus in which various processing devices are combined.

Then, the structural features of the recording head of the invention will be described in detail with reference to FIGS. 2A and 2B.

First Embodiment

Figure 2A:
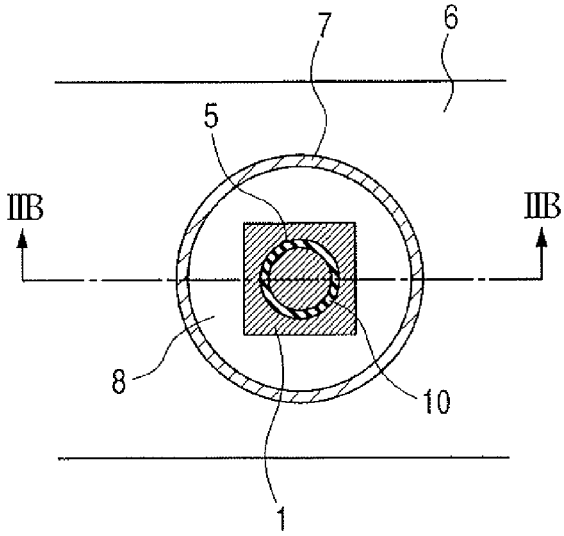
FIG. 2A is a perspective plan view showing a structure example around a discharge port of the ink jet recording head according to a first embodiment of the invention.

FIG. 2A is a perspective plan view showing the discharge port 5 included in the ink jet recording head shown in FIG. 1 when viewed from the discharge port 5 toward a direction of the substrate 2. FIG. 2B is a sectional view taken along line IIB-IIB and perpendicular to the substrate 2 of FIG. 2A. As shown in FIGS. 2A and 2B, the recording head of the invention has a second wall member 7 around the heating resistive element 1. The second wall member 7 has a height in a direction from the substrate 2 to a first wall member 9. The discharge port 5 is formed in the first wall member 9. The first wall member 9 is a component of an ink channel wall forming member 4, and is provided so as to face the substrate 2. The first wall member 9 has a wall surface 16 which faces the substrate 2 and is substantially parallel to the substrate 2. The first wall member 9 also has a protrusion portion 10 which is protruded from the wall surface 16 toward the substrate direction. The protrusion portion 10 has an opening 14 at an end portion on the heating resistive element side, and the discharge port 5 which is of an opening on the side of the first wall member 9 and the opening 14 are communicated with each other through the protrusion portion 10. A distance h1 between the end portion of the second wall member 7 and the substrate 2 is larger than a distance h2 between the opening 14 and the substrate 2. The end portion on the heating resistive element side of the protrusion portion 10 is included in a region 8 formed on the side of the heating resistive element 1 by surrounding the heating resistive element 1 with the second wall member 7. It is not always necessary that the second wall member 7 provided around the heating resistive element 1 surrounds the heating resistive element 1 with the continuous shape. In the invention, as described later, the second wall member 7 may be formed in a discontinuous shape or a shape in which a slit is provided in the second wall member 7. Further, a thickness of second wall member 7 with respect to a direction parallel to a substrate 2 may be set freely as long as ink is not prevented from flowing. A projection region (equivalent to an outer circumference of projection portion 10) of projection portion 10 to the substrate 2 with respect to a direction toward the heating resistive element 1 is included in a region of the heating resistive element 1.

Then, behaviors of the ink and bubble during the ink discharge in the recording head of the invention will be described with reference to FIGS. 3A, 3B, 3C, 3D, 3E, 3F, 3G and 3H.

FIGS. 3A, 3B, 3C, 3D, 3E, 3F, 3G and 3H are schematic sectional views showing the behaviors in time sequences until the ink is refilled since the ink was discharged from the ink jet recording head according to the first embodiment of the invention. The cross-section is similar to the cross-section of FIG. 2B.

Figure 3A:
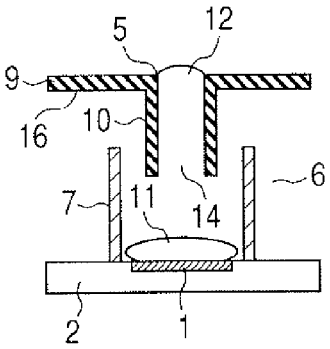
FIGS. 3A, 3B, 3C, 3D, 3E, 3F, 3G and 3H are schematic sectional views showing behaviors of ink and a bubble in time sequences when the ink is discharged by the ink jet recording head according to the first embodiment of the invention.
Figure 3B:
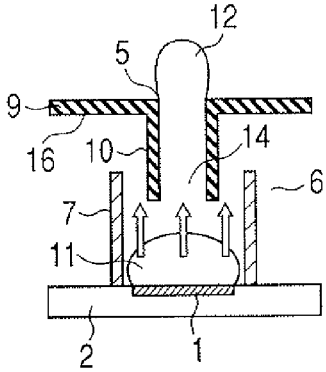
Figure 3C:
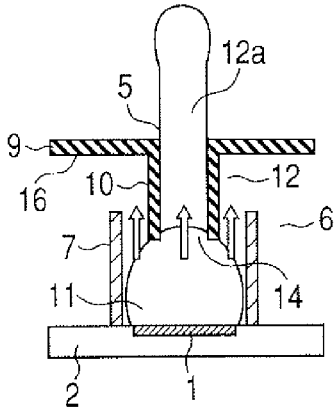
Figure 3D:
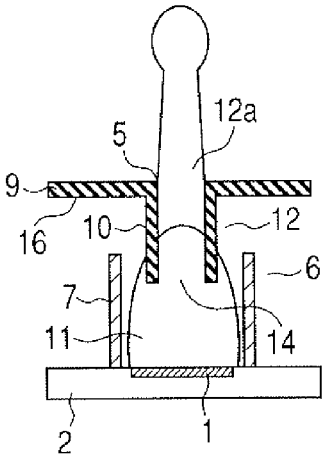

As shown in FIG. 3A, when an electric signal is applied to the heating resistive element 1, a bubble 11 is formed by thermal energy generated from the heating resistive element 1, and ink 12 filled by the growth pressure of the bubble 11 is started to be discharged from the discharge port 5 as shown in FIG. 3B. At this point, because the second wall member 7 promotes the growth of the bubble 11 from the heating resistive element 1 in the direction toward the first wall member 9, the bubble 11 is better grown from the heating resistive element 1 in the direction toward the first wall member 9 (white arrow in FIG. 3B) compared with the state in which the second wall member 7 does not exist. When the growth of the bubble 11 is continued in this state, a part of the bubble 11 is divided by bringing the bubble 11 into contact with the end portion of the protrusion portion 10, and thereby the opening 14 is closed by the bubble, as shown in FIG. 3C. Therefore, ink 12*a* discharged from the discharge port 5 through the protrusion portion 10 becomes the state in which the ink 12*a* is separated and blocked from the ink 12 in the ink channel 6. Even if the ink 12*a* is not completely blocked from the ink 12, there is an extremely small amount of ink 12 in the ink channel 6, which is connected to the ink existing in the region 8 through the second wall member and the protrusion portion.

Figure 3E:
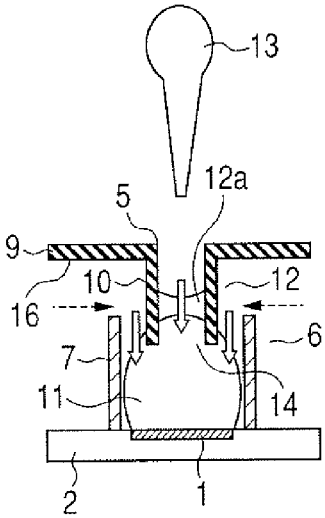

The bubble 11 of the protrusion portion 10 is continuously grown until the surrounding ink loses inertial force (FIG. 3D), and the bubble 11 is eliminated after the bubble 11 is grown to the maximum, which allows an ink droplet 13 to be separated from the ink 12*a* (FIG. 3E).

Figure 3F:
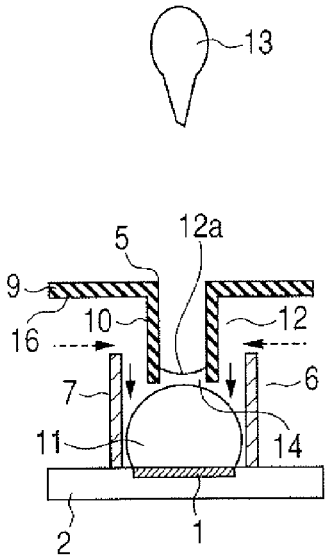

Then, the protrusion portion 10 and the bubble 11 are separated from each other as the elimination of the bubble 11 progresses, which releases the blockage between the ink 12 in the ink channel 6 and the ink 12*a* existing in the protrusion portion 10 to activate the mutual ink flow (FIG. 3F).

Figure 3G:
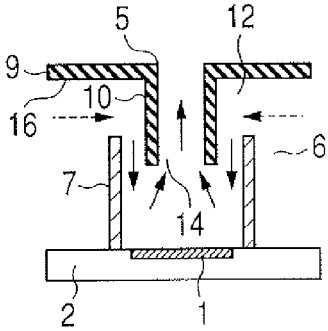
Figure 3H:
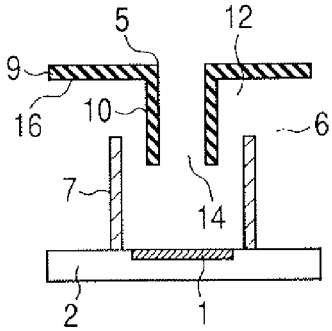

The bubble 11 is eliminated, and the ink 12 is refilled toward the discharge port 5 through the ink channel 6 and the opening 14 (FIG. 3G). Then, a meniscus is stabilized near the discharge port 5 to complete the refill (FIG. 3H).

Thus, in the recording head of the invention, because the ink discharged during the discharge and the ink in the ink channel are separated from each other by the bubble, the ink in the ink channel is not supplied to the discharged ink, and the droplet tail can be suppressed to a low level. Even if the bubble is not brought into contact with the protrusion portion 10, the same effect is obtained because of the extremely small amount of available ink.

As shown in FIGS. 3B and 3C, in the recording head of the invention, the growth direction of the bubble 11 during its growth is the direction from the heating resistive element 1 toward the first wall member 9 (white arrow in FIGS. 3B and 3C). The white arrows shown in FIGS. 3B and 3C are substantially orthogonal to a main flow direction of the ink 12 (black broken-line arrow in FIGS. 3E, 3F, and 3G) in the ink refill shown in FIGS. 3E, 3F, and 3G. On the other hand, in the conventional technique disclosed in U.S. Pat. No. 6,561,631, the pressure by the growth of the bubble 11 during the discharge is applied in the opposite direction to the main flow direction of the ink during the ink refill. That is, the pressure is applied in the direction in which the pressure blocks the refill.

However, in the recording head of the invention, the bubble growth pressure in the opposite direction to the main flow direction of the ink in the ink refill is suppressed by providing the second wall member 7. Therefore, when compared with the conventional technique, the speed-up of the ink refill is achieved while the generation of the satellite is suppressed. In the case where the flow resistance in the ink channel is provided in order to obtain the same satellite suppression effect as the invention in the conventional technique, it is thought that a time necessary for the ink refill becomes about three times the invention.

The invention will be described in more detail by other embodiments.

Second Embodiment

A second embodiment of the invention will be described with reference to FIG. 4. The second embodiment is the case in which the refill characteristics can be improved while the satellite reduction effect is maintained.

Figure 4:
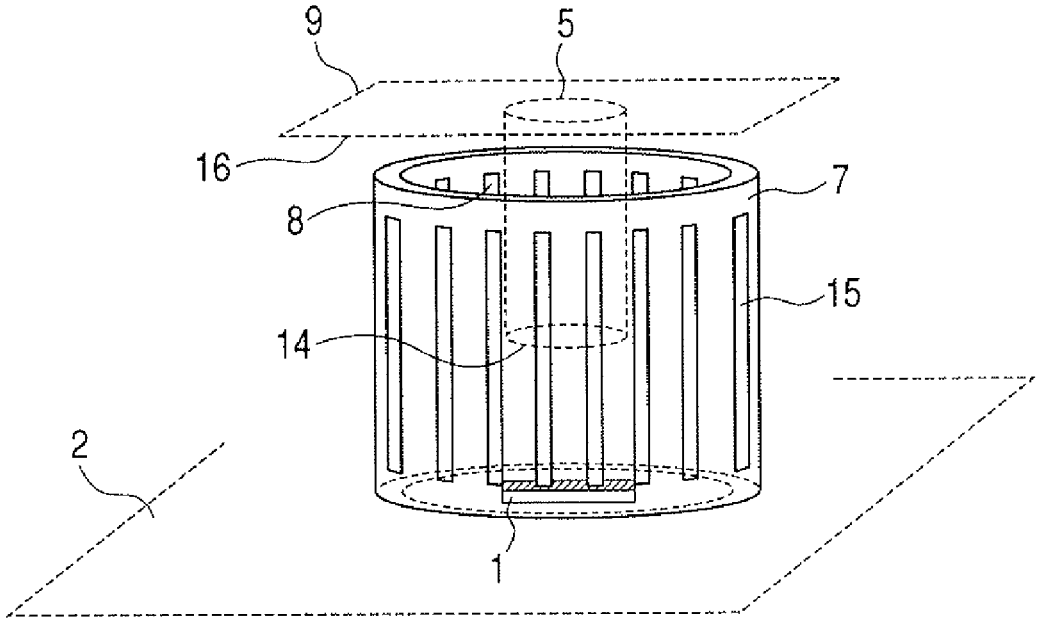
FIG. 4 is a schematic sectional view showing a structure around the discharge port of an ink jet recording head according to a second embodiment of the invention.

FIG. 4 is an explanatory view showing the structure of the recording head according to the second embodiment of the invention, and FIG. 4 is a perspective view showing the heating resistive element 1 and the surroundings thereof.

As shown in FIG. 4, in the second embodiment, slits 15 are provided in the second wall member 7. Other components are similar to those of the first embodiment. The second wall member 7 has the slits 15, and thereby the region 8 on the side of the heating resistive element 1, which is surrounded by the second wall member 7, is communicated with a region on the side of the ink channel 6 through the slits 15. The ink in the region 8 and the ink in the region on the side of the ink channel 6 can mutually flow through the slit 15, which leads to the improvement of the refill characteristics. As described above, it is necessary that the second wall member 7 promotes the bubble growth in the discharge port direction to have the effect of reducing the satellite. There is no particular limitation to the shape of the slit 15 as long as the satellite reduction effect is obtained. For example, the end portion on the side of the first wall member 9 of the second wall member 7 may be formed in a discontinuous shape, and the second wall member and the slit-like space may be formed as a whole by plural independent members.

Third Embodiment

A third embodiment of the invention will be described with reference to FIG. 5. The third embodiment is the case in which the further improvement of the refill characteristics is achieved by another method different from the second embodiment in addition to the basic configuration of the invention.

Figure 2B:
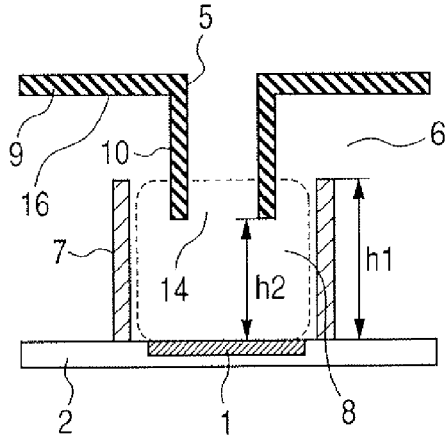
FIG. 2B is a schematic sectional view showing the structure example.
Figure 5:
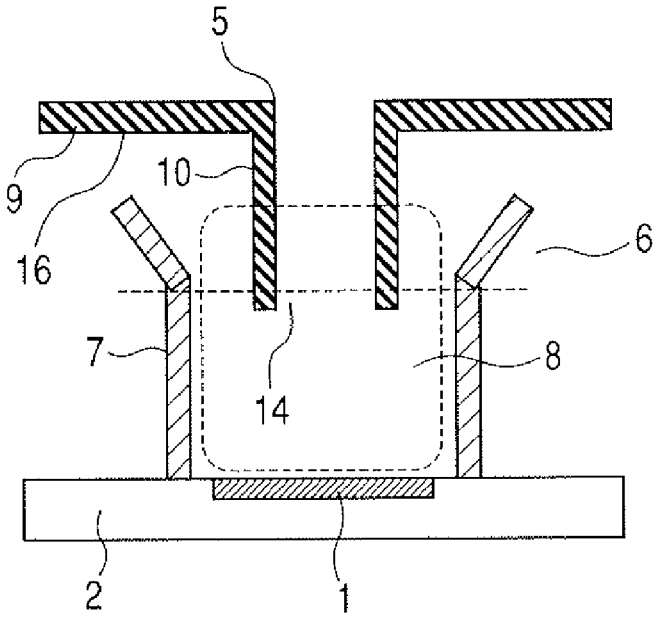
FIG. 5 is a schematic sectional view showing the structure around the discharge port of an ink jet recording head according to a third embodiment of the invention.

FIG. 5 is an explanatory view showing the structure of the ink jet recording head according to the third embodiment of the invention, and is a sectional view with a cross-section similar to that of FIG. 2B.

As shown in FIG. 5, in the third embodiment, the second wall member 7 has a structure in which the second wall member 7 is spread so as to be moved away from the protrusion portion 10 when a height in the direction of the first wall member 9 exceeds the opening 14. The structure enables the communication region to be increased between the region 8 and the ink channel 6, which results in the decreased flow resistance during the refill. There is no particular limitation to a degree to which the second wall member 7 is spread as long as the satellite reduction effect is obtained. Other components are similar to those of the first embodiment.

Fourth Embodiment

A fourth embodiment of the invention will be described with reference to FIGS. 6A and 6B. The fourth embodiment can preferably used in the case where the blockage between the ink in the ink channel and the discharge ink droplet is performed more efficiently by the bubble during the discharge.

Figure 6A:
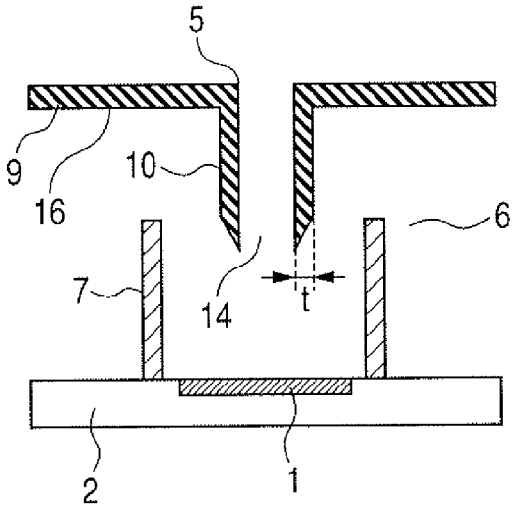
FIGS. 6A and 6B are schematic sectional views showing the structure around the discharge port of an ink jet recording head according to a fourth embodiment of the invention.
Figure 6B:
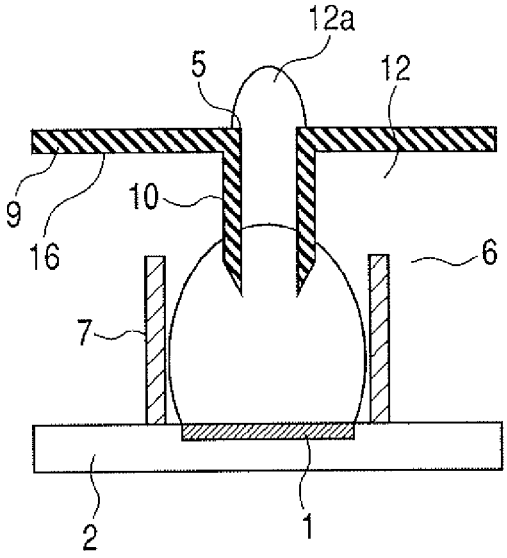

FIGS. 6A and 6B are explanatory views showing the structure of the ink jet recording head according to the fourth embodiment of the invention, and are sectional views with cross-sections similar to that of FIG. 2B.

As shown in FIG. 6A, in the fourth embodiment, a thickness t of the protrusion portion 10 is thinned as the end portion of the protrusion portion 10 is closer to the heating resistive element 1, and the protrusion portion 10 has a sharp-pointed front end.

For example, when an inner diameter of the discharge port 5 is set at an extremely small level in order to discharge the micro droplet, the inner diameter of the opening 14 becomes also small. Therefore, the flow resistance is increased in the opening 14, which becomes the trouble when the bubble closes the opening 14 during the discharge, and sometimes the blockage becomes insufficient between the ink 12 in the ink channel 6 and the ink 12*a* going toward the discharge port.

As shown in FIG. 6B, in the recording head of the fourth embodiment, because the pressure can be applied to the bubble 11 grown to the end portion of the protrusion portion 10 not by a plane but by a line, the end portion of the protrusion portion 10 easily enters the inside of the bubble 11. As a result, the bubble 11 is smoothly introduced from the opening 14 toward the discharge port 5 to efficiently perform the blockage between the ink 12 in the ink channel and the discharged ink 12*a*. Other components are similar to those of the first embodiment.

Thus, according to the recording head of the fourth embodiment, the satellite reduction effect is obtained even if the discharge port diameter is extremely small.

Fifth Embodiment

A fifth embodiment of the invention will be described with reference to FIG. 7. The fifth embodiment is preferably used in the case where the plural heating resistive elements are individually surrounded by the ink channel wall forming member.

Figure 7:
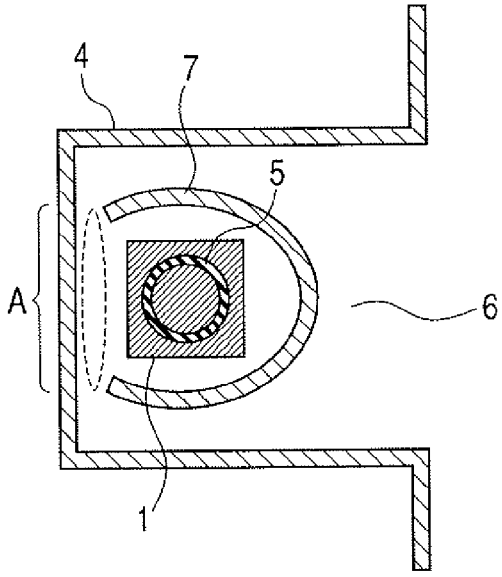
FIG. 7 is a perspective plan view showing the structure around the discharge port of an ink jet recording head according to a fifth embodiment of the invention.

FIG. 7 is a perspective plan view showing a part of the ink jet recording head of the invention when viewed from the discharge port direction toward the substrate direction.

As shown in FIG. 7, the heating resistive element 5 is surrounded by the ink channel wall forming member 4. In this case, when the distance between the heating resistive element 1 and the ink channel wall forming member 4 is sufficiently small, the ink channel wall forming member 4 can act as the above-described second wall member to promote the growth of the bubble in the discharge port direction.

In the fifth embodiment, the corresponding region (A in FIG. 7) of the ink channel wall forming member 4 acts as the second wall member. The second wall member is not provided in the region shown by the broken line in FIG. 7 between the region A and the heating resistive element 1. Other components are similar to those of the first embodiment.

Accordingly, the communication region between the ink channel 6 and the discharge port 5 is increased to improve the refill characteristics compared with the case where the second wall member is located in the broken-line region. As for the bubble growth promoted in the discharge port direction by the corresponding region A of the ink channel wall forming member 4, the substantially same effect as the case where the second wall member exists in the broken-line region is obtained.

Thus, in the recording head of the fifth embodiment, the refill characteristics are further improved while the satellite reduction effect is maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-253544, filed Sep. 1, 2005, which is hereby incorporated by reference herein in its entirety.

What is claimed is:

1. A liquid discharge head comprising:

a substrate which has a heat generating element for generating a bubble in a liquid;

a first wall member provided with a discharge port for discharging liquid and facing the heat generating element;

a liquid channel communicating with the discharge port formed between the substrate and the first wall member, and including a protrusion portion protruding from a surface of the first wall member toward the heat generating element, wherein a projection of an end portion of the protrusion portion is completely within a perimeter of the heat generating element when viewed from the discharge port toward the substrate; and a second wall member provided around the protrusion portion and protruding toward the first wall member from a surface of the substrate such that a gap between an end portion of the second wall member and the first wall member and a gap between the end portion of the second wall member and the protrusion portion form a portion of the channel and the end portion of the protrusion portion is closer to the heat generating element than the end portion of the second wall member.

2. A liquid discharge head according to claim 1, wherein, in a region which is closer to the first wall member than the end portion of the protrusion portion, a distance between the second wall member and the protrusion portion is widened as the second wall member is closer to the first wall member.

3. A liquid discharge head according to claim 1, wherein, in a section including the end portion of the protrusion portion, a thickness of the protrusion portion is decreased as the protrusion portion is closer to the heat generating element.

4. A liquid discharge head according to claim 1, wherein one portion of the heat generating element is surrounded by another first wall member constituting the liquid channel, and the second wall member is provided in another portion of the surroundings of the heat generating element.

5. A liquid discharge head according to claim 1, wherein the bubble generated from the heat generating portion in order to discharge the liquid reaches the protrusion portion when the liquid is discharged.

6. A liquid discharge head according to claim 1, wherein a slit is provided in at least a part of the second wall member.

* * * * *